US011703045B2

(12) United States Patent
Mou et al.

(10) Patent No.: US 11,703,045 B2
(45) Date of Patent: Jul. 18, 2023

(54) THIN GAS TRANSPORTATION DEVICE

(71) Applicant: Microjet Technology Co., Ltd., Hsinchu (TW)

(72) Inventors: Hao-Jan Mou, Hsinchu (TW); Chung-Wei Kao, Hsinchu (TW); Shih-Chang Chen, Hsinchu (TW); Jyun-Yi Jhang, Hsinchu (TW); Yung-Lung Han, Hsinchu (TW); Chi-Feng Huang, Hsinchu (TW); Chun-Yi Kuo, Hsinchu (TW)

(73) Assignee: Microjet Technology Co., Ltd., Hsinchu (TW)

( * ) Notice: Subject to any disclaimer, the term of this patent is extended or adjusted under 35 U.S.C. 154(b) by 0 days.

(21) Appl. No.: 17/585,794

(22) Filed: Jan. 27, 2022

(65) Prior Publication Data

US 2022/0243715 A1 Aug. 4, 2022

(30) Foreign Application Priority Data

Jan. 29, 2021 (TW) ..... 110103456

(51) Int. Cl.
*F04B 45/067* (2006.01)
*F04B 53/10* (2006.01)
(Continued)

(52) U.S. Cl.
CPC ..... *F04B 45/067* (2013.01); *F04B 43/04* (2013.01); *F04B 43/046* (2013.01);
(Continued)

(58) Field of Classification Search
CPC ..... F04B 43/04; F04B 43/043; F04B 43/046; F04B 45/067; F04B 53/1075; F04B 53/16; F04B 19/006
See application file for complete search history.

(56) References Cited

U.S. PATENT DOCUMENTS

2008/0095651 A1* 4/2008 Onishi ..... F04B 53/1065 417/558
2019/0249656 A1* 8/2019 Takahashi ..... F04B 53/1065
(Continued)

FOREIGN PATENT DOCUMENTS

JP 5-172060 A 7/1993
JP 10-220357 A 8/1998
(Continued)

*Primary Examiner* — Charles G Freay
(74) *Attorney, Agent, or Firm* — Birch, Stewart, Kolasch & Birch, LLP

(57) ABSTRACT

A thin gas transportation device is provided and includes a shell, a check valve and a gas pump. The shell includes a shell surface, an accommodation slot and an outlet slot. The accommodation slot is recessed from the shell surface and includes an accommodation bottom surface. The outlet slot is recessed from the accommodation bottom surface. The check valve is disposed within the accommodation slot and includes a barrier plate and a valve plate. The barrier plate is disposed on the accommodation bottom surface and covers the outlet slot. The barrier plate includes a first surface, a second surface, a protruding part and a plurality of perforations. The protruding part is protruding from the second surface and located at the outlet slot. The valve plate is coupled to the second surface, and the protruding part abuts against the valve part and seals the valve hole.

20 Claims, 16 Drawing Sheets

(51) Int. Cl.
*F04B 43/04* (2006.01)
*F04B 19/00* (2006.01)

(52) U.S. Cl.
CPC ..... *F04B 53/1075* (2013.01); *F04B 19/006* (2013.01); *F04B 43/043* (2013.01)

(56) References Cited

U.S. PATENT DOCUMENTS

| | | | | |
|---|---|---|---|---|
| 2020/0232451 | A1* | 7/2020 | Tanaka | F04B 53/1037 |
| 2020/0318630 | A1* | 10/2020 | Kondo | F04B 45/047 |
| 2020/0355278 | A1* | 11/2020 | Kawamura | F16K 27/0236 |

FOREIGN PATENT DOCUMENTS

| | | | |
|---|---|---|---|
| JP | 2006-46272 | A | 2/2006 |
| TW | M507977 | U | 9/2015 |
| TW | M542078 | U | 5/2017 |
| TW | M582533 | U | 8/2019 |

* cited by examiner

THIN GAS TRANSPORTATION DEVICE

FIELD OF THE INVENTION

The present disclosure relates to a thin gas transportation device, and more particularly to a thin gas transportation device capable of preventing the backflow of gas.

BACKGROUND OF THE INVENTION

With the rapid development of science and technology, the applications of gas transportation devices are becoming more and more diversified. For example, gas transportation devices are gradually popular in industrial applications, biomedical applications, medical care applications, electronic cooling applications and so on, or even the wearable devices. It is obvious that the gas transportation devices gradually tend to miniaturize the structure and maximize the flow rate thereof.

Presently, a conventional thin gas transportation device is used to inflate an airbag. When the inflation is completed and the operation of the thin gas transportation device is disabled, the phenomena of gas backflow usually takes place. As a result, the inner pressure of the inflated load is insufficient. Therefore, how to avoid the backflow after the conventional thin gas transportation device is disabled is the problem needed to be solved.

FIGS. 1A and 1B are schematic views illustrating a conventional thin gas transportation device. As shown in the FIGS. 1A and 1B, the conventional thin gas transportation device 200 includes a lower board 201, a gas pump 202 and an upper board 203. The lower board includes an accommodation zone 2011, a through hole 2012, a gas plug 2013, an inlet end 2014 and an outlet end 2015. The gas pump 202 is disposed in the accommodation zone 2011. The gas plug 2013 is disposed in the through hole 2012. The upper board 203 covers the accommodation zone 2011. When the gas pump 202 is enabled, the gas inside the accommodation zone 2011 is pushed and transported toward the outlet end 2015 by the gas pump 202. As a result, a negative pressure is generated in the space inside the accommodation zone 2011, the gas flows into the through hole 2012 through the inlet end 2014 and then pushes the gas plug 2013 disposed in the through hole 2012 to move upwardly. Consequently, the gas can be transported constantly. When the gas pump 202 is disabled, the gas plug 2013 elastically returns into the through hole 2012 and blocks the through hole 2012.

The conventional thin gas transportation device utilizes the gas plug 2013 to prevent the backflow, however, the gas plug 2013 is extremely small, the quality of the gas plug 2013 is not easy to keep due to the tolerance during the manufacturing process of the gas plug 2013. On the other hand, the gas plug 2013 also needs to be matched up with the through hole 2012, otherwise it will cause the backflow or the failure of assembly. Therefore, it still needs to find another way to avoid the backflow phenomena of gas for the thin gas transportation device.

SUMMARY OF THE INVENTION

An object of the present disclosure is to provide a thin gas transportation device utilizing a check valve to achieve the efficacy of preventing the backflow.

In accordance with an aspect of the present disclosure, a thin gas transportation device is provided. The thin gas transportation device includes a shell, a check valve, a gas pump and a top cover. The shell includes a shell surface, an accommodation slot, an outlet slot, a positioning part, a vent hole, an inlet pipe and an outlet pipe. The accommodation slot is recessed from the shell surface and includes an accommodation bottom surface. The outlet slot is recessed from the accommodation bottom surface. The positioning part is protruded from the shell surface and surrounds the accommodation slot. The vent hole is located on the positioning part and includes an inlet end and a vent end, wherein the vent end is in fluid communication with the accommodation slot, and the vent hole is tapered from the vent end to the inlet end. The inlet pipe is disposed on the shell and includes an inlet passage, wherein the inlet passage is in fluid communication with the inlet end of the vent hole. The outlet pipe is disposed on the shell and includes an outlet passage, wherein the outlet passage is in fluid communication with the outlet slot. The check valve is disposed within the accommodation slot and includes a barrier plate and a valve plate. The barrier plate is disposed on the accommodation bottom surface and covers the outlet slot. The barrier plate includes a first surface, a second surface, a protruding part and a plurality of perforations. The second surface is opposed to the first surface. The protruding part is protruding from the second surface and located at the outlet slot. The plurality of perforations surrounds the protruding part. The valve plate is disposed on the second surface and includes a valve part and a fixing portion. The valve part includes a valve hole, wherein the valve hole is vertically corresponding to the protruding part. The fixing portion is located at the valve part. Wherein the valve plate is coupled to the second surface through the fixing portion, and the protruding part abuts against the valve part and seals the valve hole. The gas pump is disposed on the first surface. The top cover is fixed on the positioning part and covers the accommodation slot.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
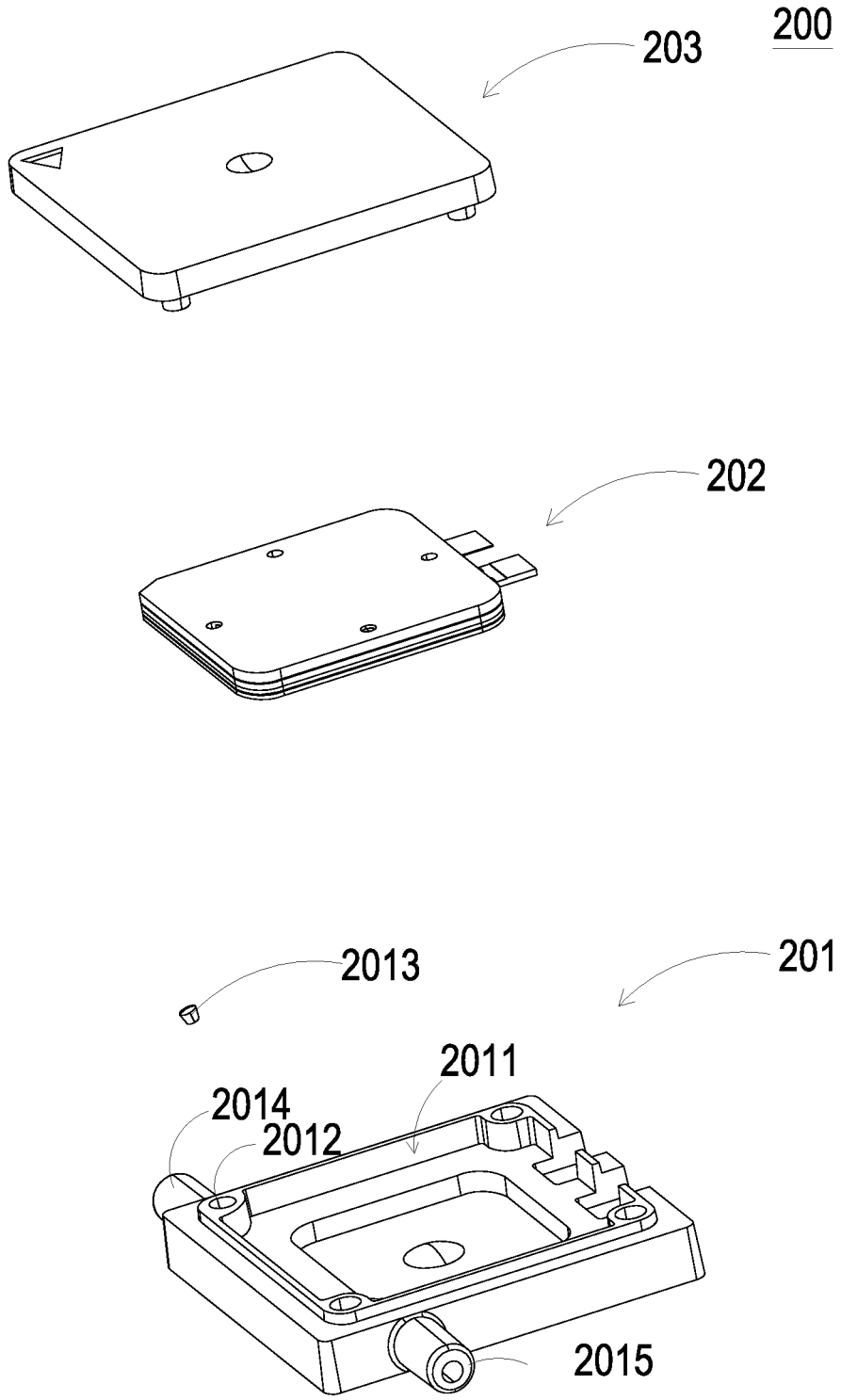
FIG. 1A PRIOR ART
FIGS. 1A and 1B are schematic views illustrating the conventional thin gas transportation device.
Figure 1B:
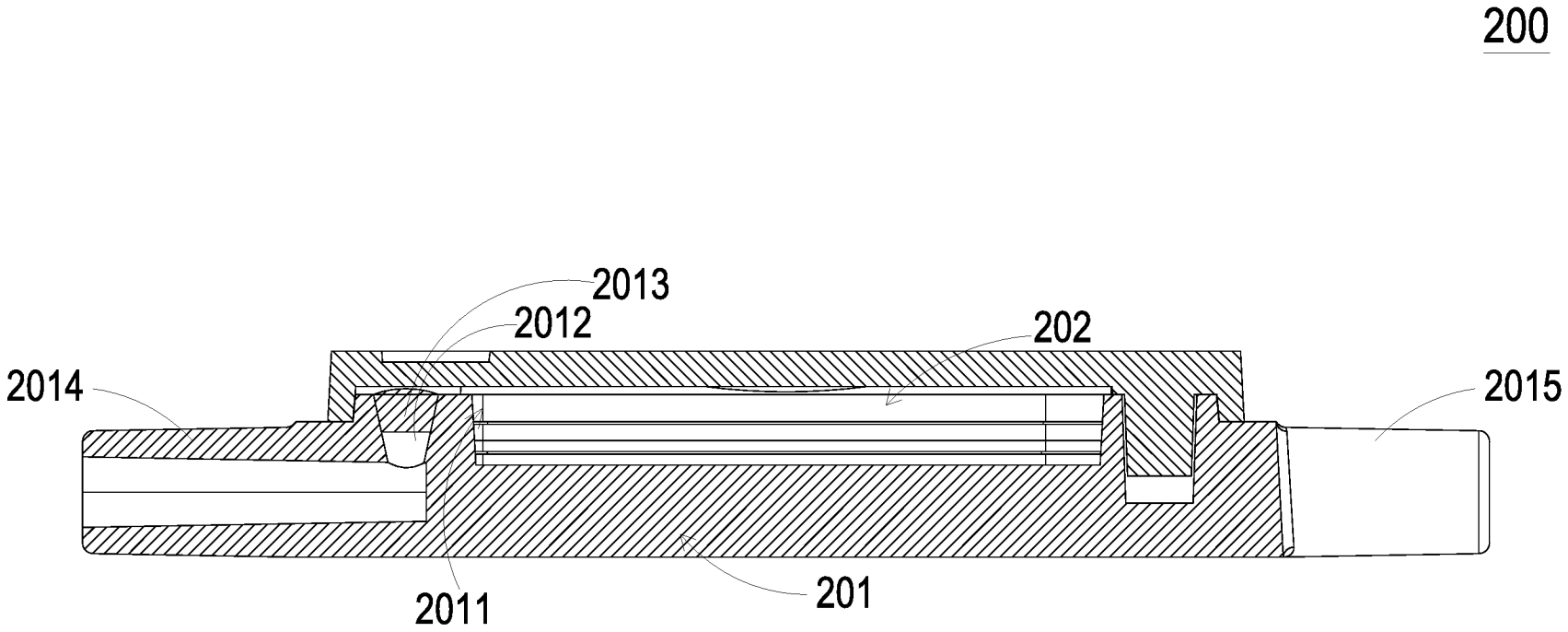
FIG. 1B PRIOR ART
Figure 2A:
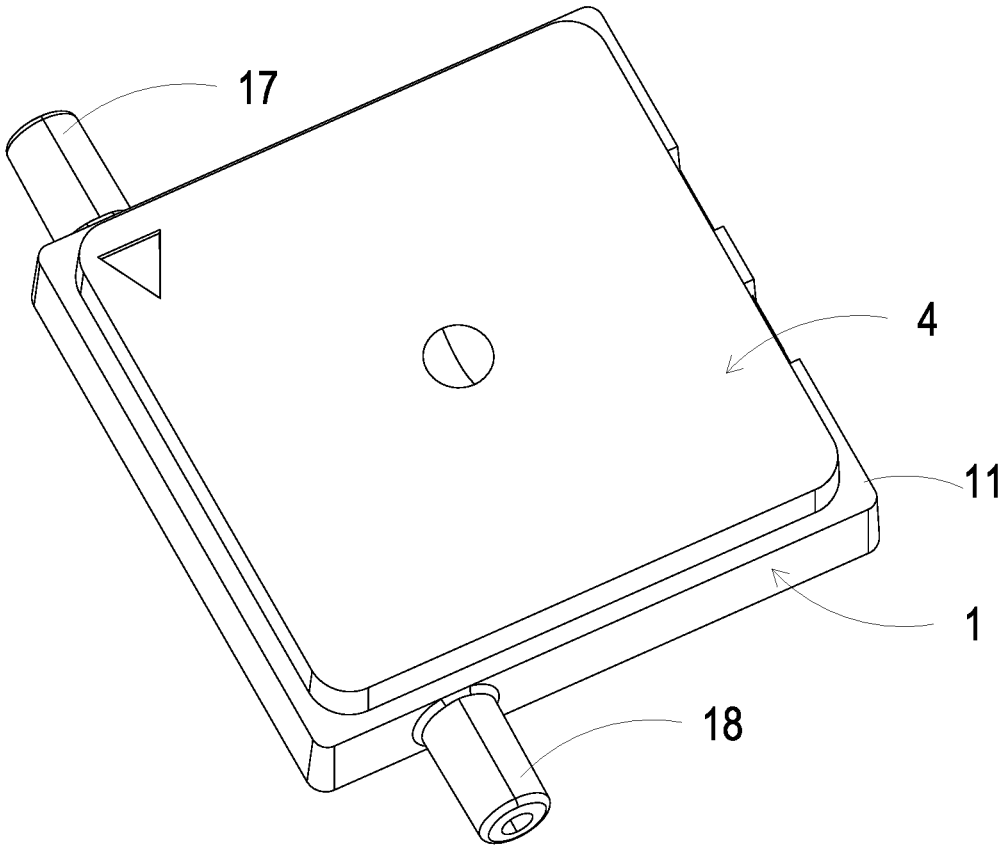
FIG. 2A is a schematic view illustrating the thin gas transportation device of the present disclosure.
Figure 2B:
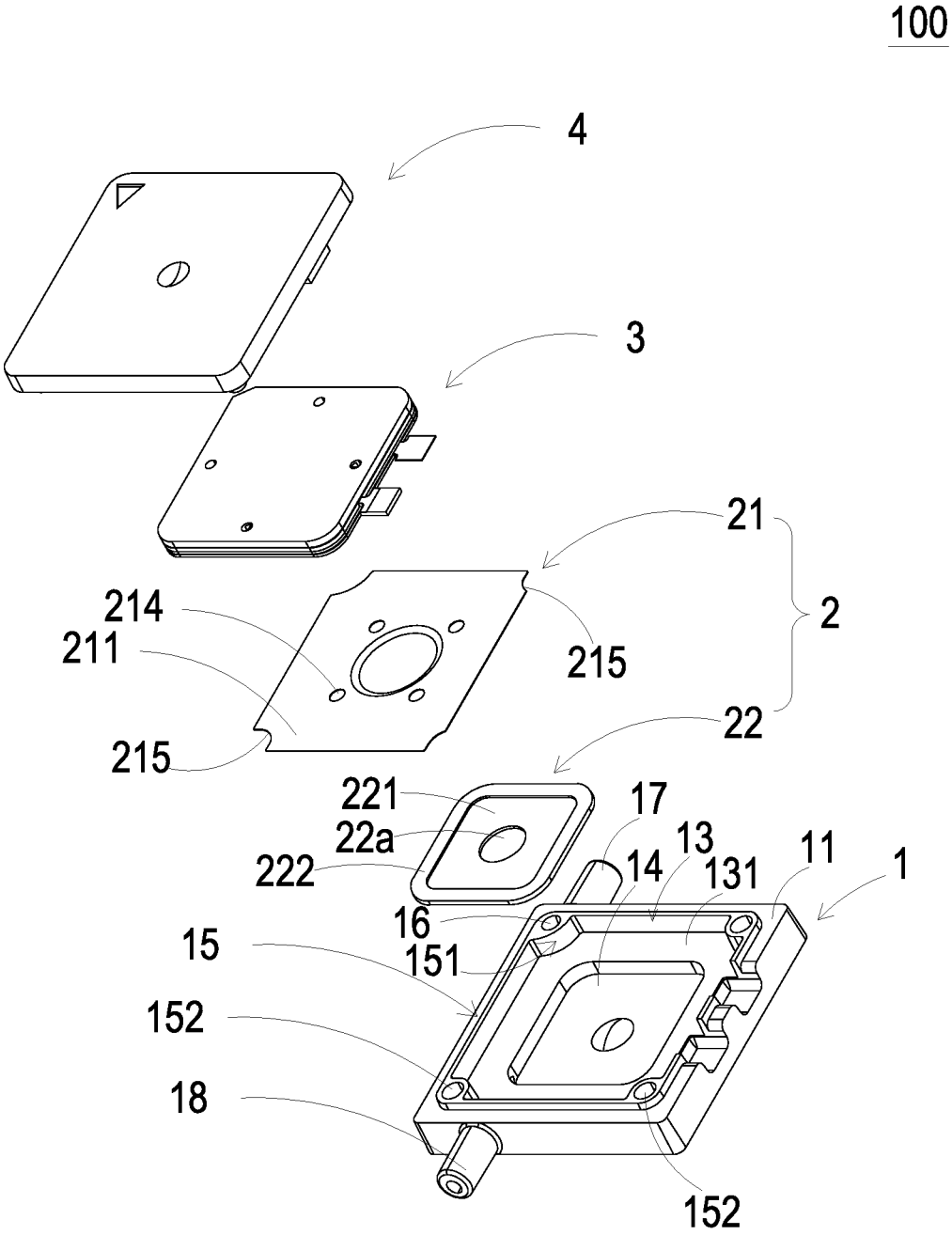
FIG. 2B is a schematic exploded view illustrating the thin gas transportation device of the present disclosure.

FIG. 2A is a schematic view illustrating the thin gas transportation device of the present disclosure, FIG. 2B is a schematic exploded view illustrating the thin gas transportation device of the present disclosure. Please refer to FIGS. 2A and 2B, the present disclosure provides the thin gas transportation device 100 including a shell 1, a check valve 2, a gas pump 3 and a top cover 4. The gas pump 3 is disposed on the check valve 2, both of the check valve 2 and the gas pump 3 are accommodated within the shell 1, and then the shell 1 covered with the top cover 4.

Figure 2C:
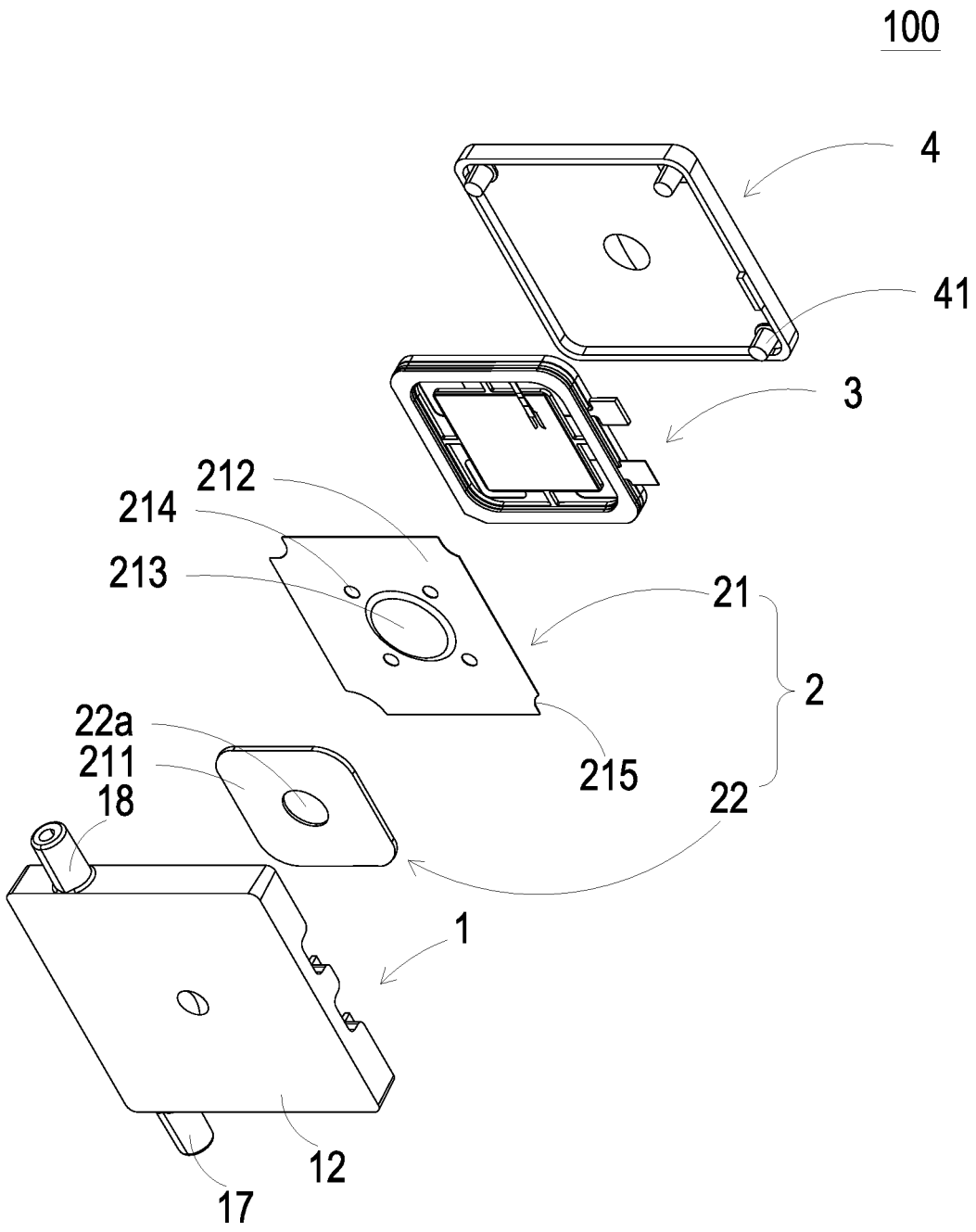
FIG. 2C is a schematic exploded view illustrating the thin gas transportation device of the present disclosure from another viewing angle.
Figure 2D:
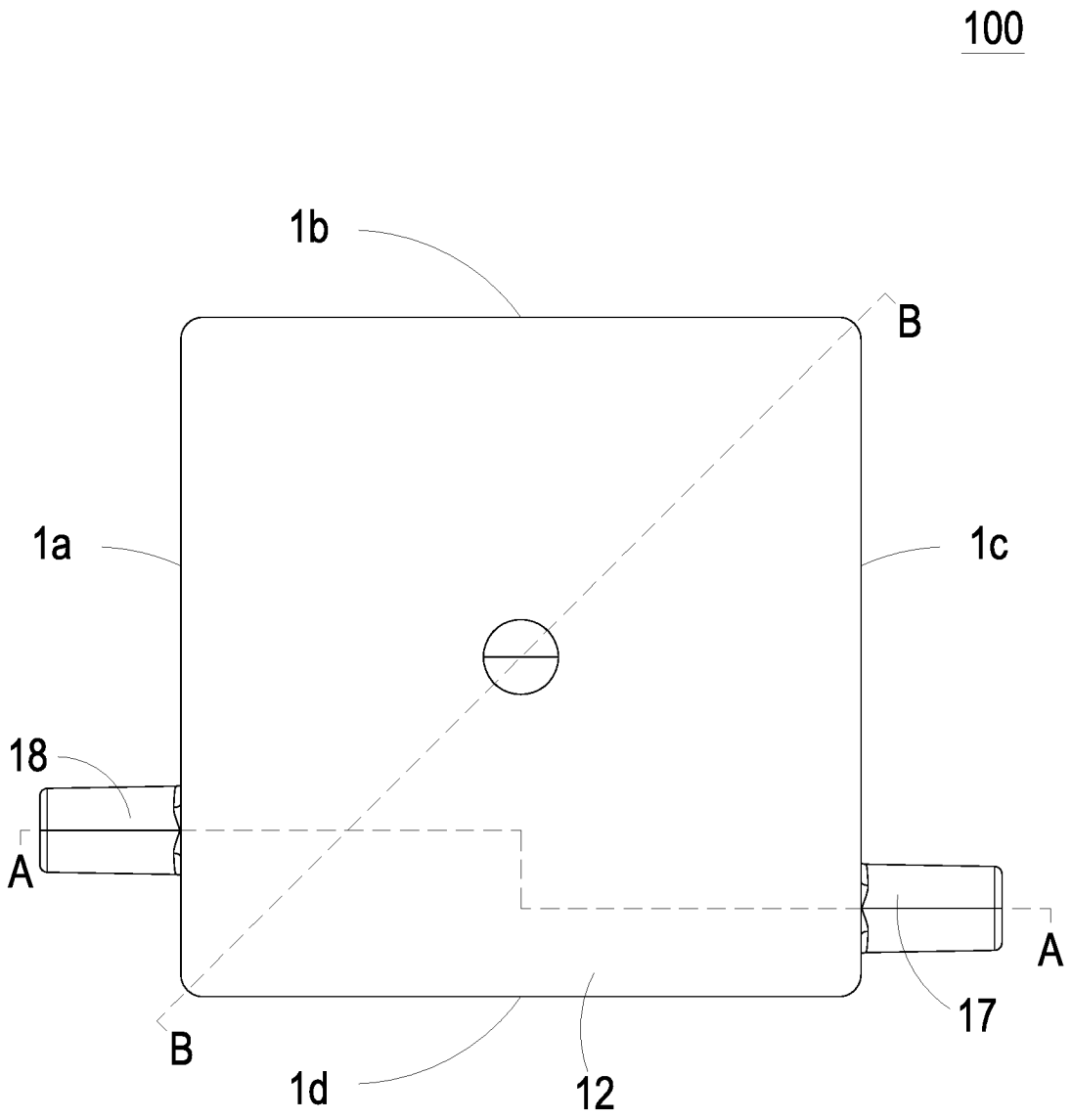
FIG. 2D is a schematic bottom view illustrating the thin gas transportation device of the present disclosure.
Figure 2E:
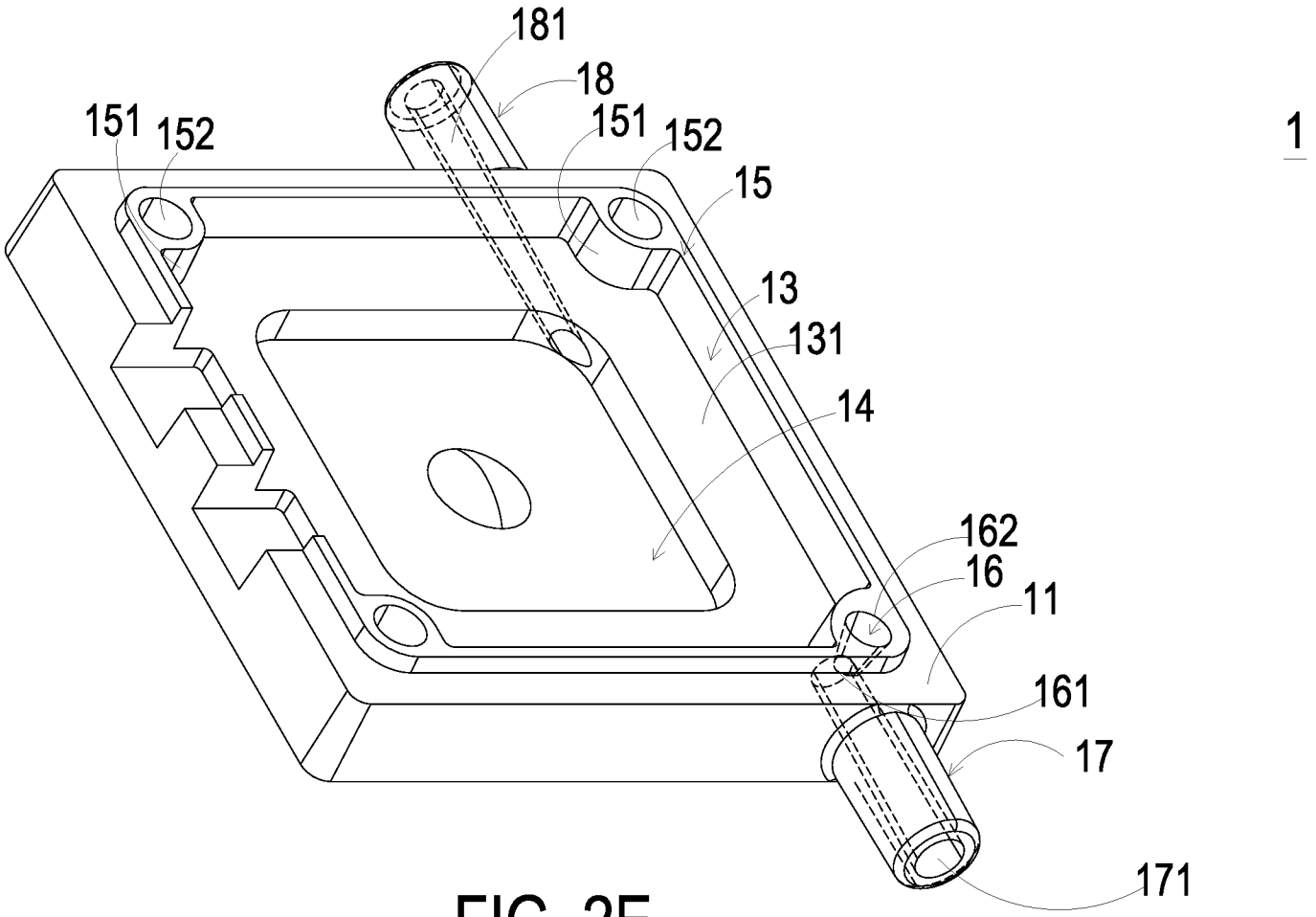
FIG. 2E is a schematic view illustrating the shell of the present disclosure.

FIG. 2E is a schematic view illustrating the shell of the present disclosure. Please refer to FIG. 2E, the shell 1 is a square-shaped shell but is not limited thereto. The shell 1 includes a shell surface 11, a bottom surface 12, an accommodation slot 13, an outlet slot 14, a positioning part 15, a vent hole 16, an inlet pipe 17, an outlet pipe 18, a first sidewall 1*a*, a second sidewall 1*b*, a third sidewall 1*c* and a fourth sidewall 1*d* (see FIG. 2D). The shell surface 11 and the bottom surface 12 are opposed to each other. The accommodation slot 13 is recessed from the shell surface 11 and includes an accommodation bottom surface 131. The outlet slot 14 is recessed from the accommodation bottom surface 131. The positioning part 15 is protruded from the shell surface 11 and surrounds the accommodation slot 13. The vent hole 16 is located on the positioning part 15 and includes an inlet end 161 and a vent end 162. The vent end 162 is in fluid communication with the accommodation slot 13, and the vent hole 16 is tapered from the vent end 162 to the inlet end 161. The inlet pipe 17 is disposed on the first sidewall 1*a* of the shell 1 and includes an inlet passage 171. The inlet passage 171 is in fluid communication with the inlet end 161 of the vent hole 16. The outlet pipe 18 is disposed on the third sidewall 1*c* of the shell 1 opposed to the first sidewall 1*a* and includes an outlet passage 181 in fluid communication with the outlet slot 14. The inlet pipe 17 and outlet pipe 18 are misaligned. It is noted that the inlet pipe 17 and the outlet pipe 18 can be disposed on the second sidewall 1*b* and fourth sidewall 1*d* which are opposed to each other. In some embodiments, the inlet pipe 17 and the outlet pipe 18 can both be disposed on the same side such as the first sidewall 1*a*, but is not limited thereto.

Please refer to FIGS. 2B and 2C again. The check valve 2 is disposed within the accommodation slot 13 of the shell 1 and includes a barrier plate 21 and a valve plate 22. The barrier plate 21 is disposed on the accommodation bottom surface 131 of the accommodation slot 13 and covers the outlet slot 14. The barrier plate 21 includes a first surface 211, a second surface 212, a protruding part 213 and a plurality of perforations 214. The first surface 211 is opposed to the second surface 212. The second surface 212 is attached on the accommodation bottom surface 131 such that the check valve 2 is fixed within the accommodation slot 13. The protruding part 213 is protruded from the second surface 212. When the second surface 212 is attached on the accommodation bottom surface 131, the protruding part 213 is located within the outlet slot 14. In this embodiment, the number of the plurality of perforations 214 is four, but is not limited thereto. The four perforations 214 surround the protruding part 213. Besides, the protruding part 213 can be formed by stamping the first surface 211 of the barrier plate 21 that makes the protruding part 213 protrude from the second surface 212. The barrier plate 21 can be made of metal material such as copper, aluminum, stainless steel or other alloys in this embodiment. The thickness of the barrier plate 21 made of the metal material is below 0.05 mm. The material and the thickness of the barrier plate 21 is restricted based on the required mechanical strength thereof. Specifically, it would be acceptable as long as the mechanical strength of the barrier plate 21 is enough for bearing the stamping process and will not over-deformed under the reaction force of the gas pressure.

The valve plate 22 is disposed on the second surface 212 of the barrier plate 21 and includes a valve part 221 and a fixing portion 222. A valve hole 22*a* is disposed at the center of the valve part 221. The valve hole 22*a* is vertically corresponding to the protruding part 213 of the barrier plate 21. The fixing portion 222 is located on the periphery of the valve part 221. When the valve plate 22 is fixed on the second surface 212 of the barrier plate 21 through the fixing portion 222, the protruding part 213 of the barrier plate 21 abuts against the valve part 221 and closes the valve hole 22*a*. The valve part 221 of the valve plate 22 can be made of pliable material such as silicone, rubber or polyimide thin film (PI film). The fixing portion 222 can be an adhesive layer, that is, the fixing portion 222 can be formed by disposing the adhesive layer on the periphery of the valve part 221. Through the adhesive layer, i.e., the fixing portion 222, the valve part 221 can be attached on the second surface 212 of the barrier plate 21 to fix the valve plate 22 on the barrier plate 21.

It is noted that the protruding part 213 of the check valve 2 is flat-and-cylindrical-shaped, and the diameter of the protruding part 213 is not less than that of the valve hole 22*a* so as to block the valve hole 22*a*. In this embodiment, the diameter of the protruding part 213 is greater than that of the valve hole 22*a*. Besides, to make the protruding part 213 abut against the valve part 221, the thickness of the protruding part 213 is not less than that of the fixing portion 222. In this embodiment, the thickness of the protruding part 213 is greater than that of the fixing portion 222 so as to allow the protruding part 213 to make the valve part 221 surrounding the valve hole 22*a* slightly deformed downwardly to obtain better backflow prevention effect.

The thickness of the valve part 221 of the valve plate 22 is 0.2 mm. The diameter of the valve hole 22*a* is 3 mm. The thickness of the fixing portion 222 is 0.14 mm. The diameter of the perforation 214 of the barrier plate 21 is 1 mm. The diameter of the protruding part 213 needs to be greater than that of the valve hole 22*a*, and therefore the diameter of the protruding part 213 is ranged between 4 mm and 5 mm. The thickness of the protruding part 213 needs to be greater than that of the fixing portion 222, and therefore the thickness of the protruding part 213 is 0.2 mm.

The gas pump 3 is disposed on the first surface 211 of the barrier plate 21. Please refer to FIGS. 3A and 3B. In this embodiment, the gas pump 3 includes a gas inlet plate 31, a resonance plate 32, a piezoelectric actuator 33, a first insulation plate 34, a conducting plate 35 and a second insulation plate 36, which are stacked on each other sequentially. In this embodiment, the gas inlet plate 31 includes at least one inlet aperture 31*a*, at least one convergence channel 31*b* and a convergence chamber 31*c*. The at least one gas inlet aperture 31*a* is configured to inhale the gas. The at least one gas inlet aperture 31*a* correspondingly penetrates through the gas inlet plate 31 into the at least one convergence channel 31*b*, and the at least one convergence channel 31*b* is converged into the convergence chamber 31*c*. Therefore, the gas inhaled through the at least one gas inlet aperture 31*a* is converged into the convergence chamber 31*c*. The number of the gas inlet apertures 31*a* is the same as the number of the convergence channels 31*b*. In this embodiment, the numbers of the gas inlet apertures 31*a* and the convergence channels 31*b* are exemplified by four, respectively, but not limited thereto. The four gas inlet apertures 31*a* penetrate through the gas inlet plate 31 into the four convergence channels 31*b*, respectively, and the four convergence channels 31*b* converge to the convergence chamber 31*c*.

Figure 3A:
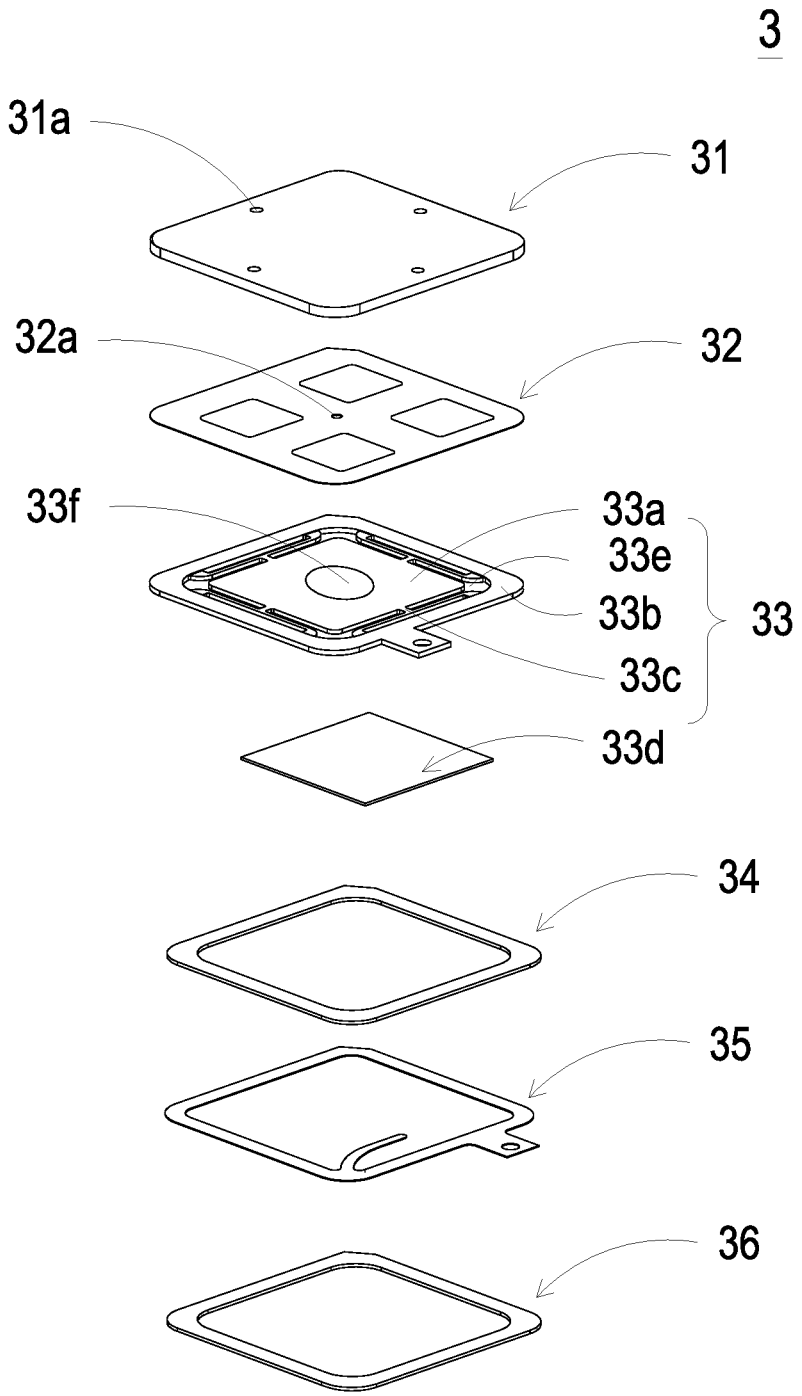
FIG. 3A is a schematic exploded view illustrating the gas pump of the present disclosure.
Figure 3B:
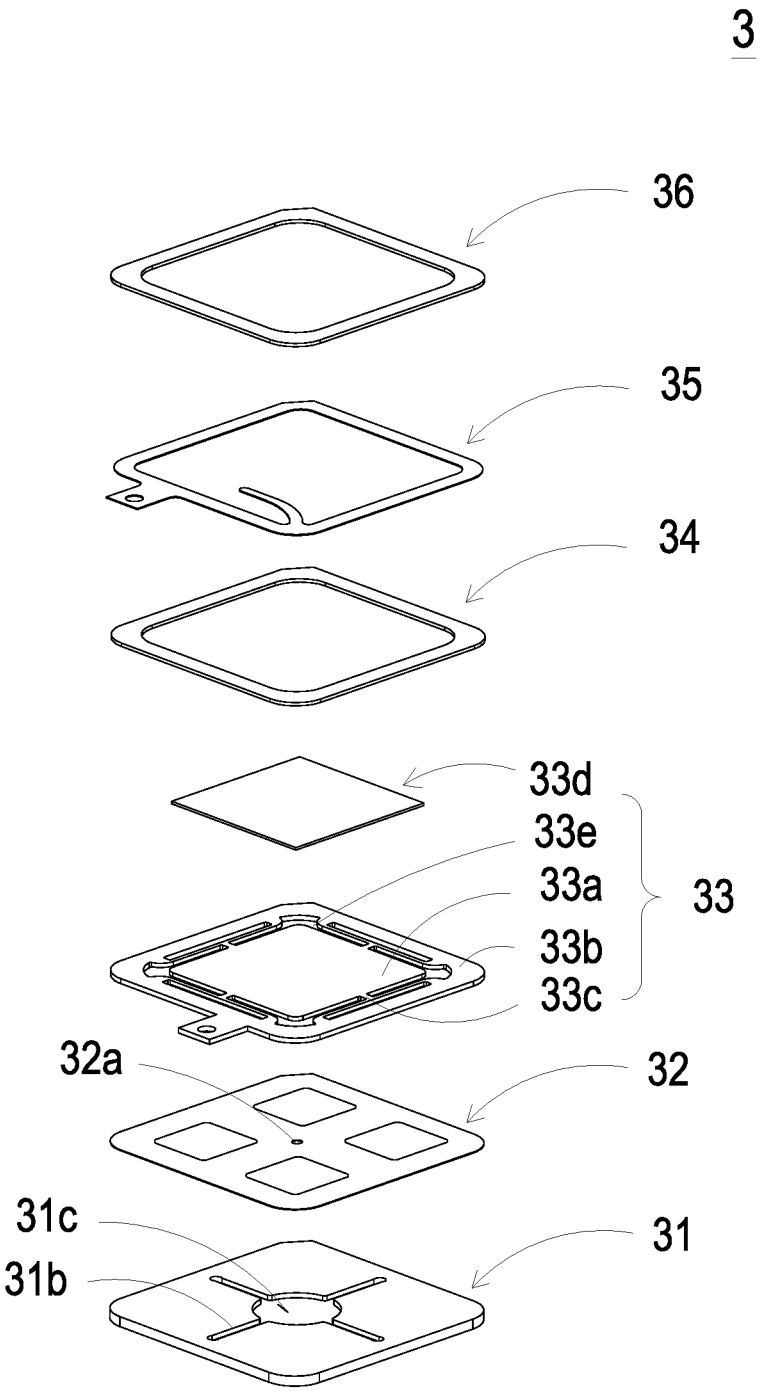
FIG. 3B is a schematic exploded view illustrating the gas pump of the present disclosure from another viewing angle.
Figure 4A:
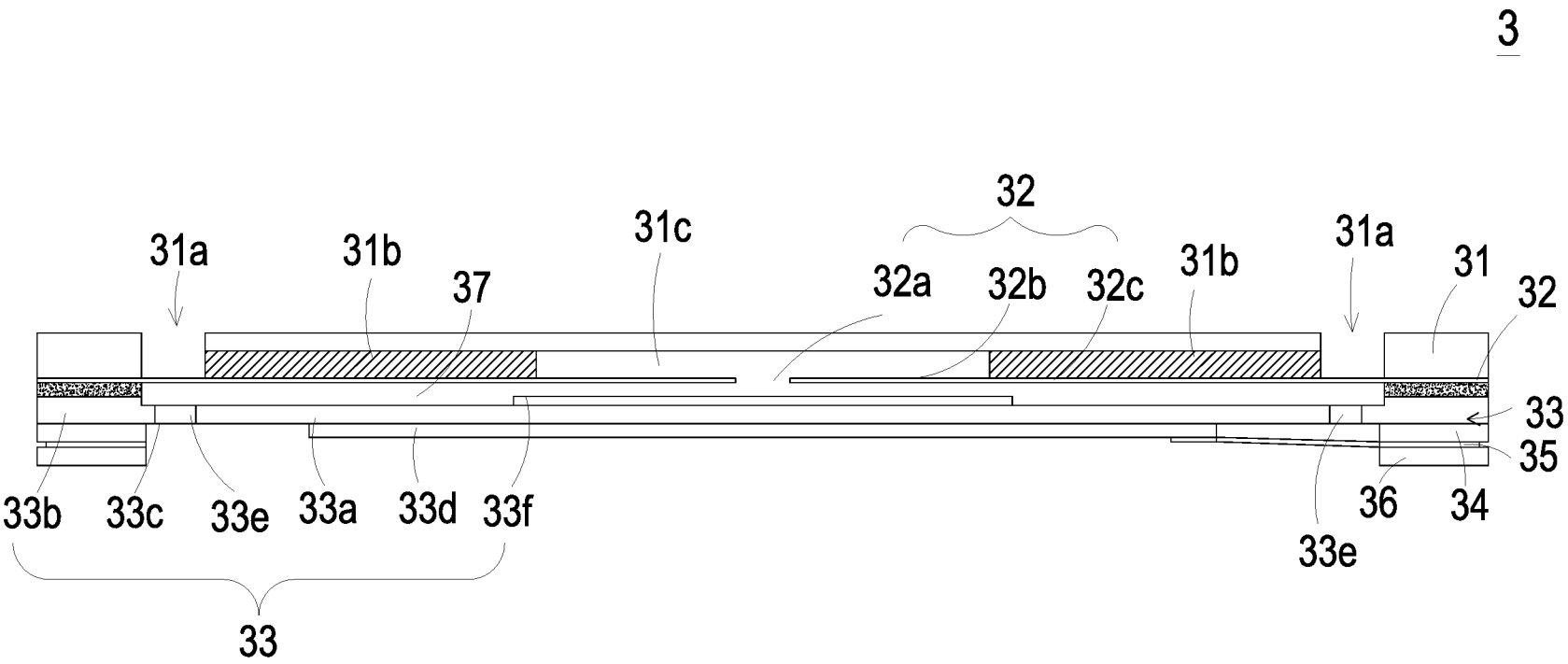
FIG. 4A is a schematic cross-sectional view illustrating the gas pump of the present disclosure.

Please refer to FIGS. 3A, 3B and 4A. The resonance plate 32 is attached on the gas inlet plate 31. The resonance plate 32 has a central aperture 32*a*, a movable part 32*b* and a fixed part 32*c*. The central aperture 32*a* is located at a center of the resonance plate 32 and is corresponding to the convergence chamber 31*c* of the gas inlet plate 31. The movable part 32*b* surrounds the central aperture 32*a* and is corresponding to the convergence chamber 31*c*. The fixed part 32*c* is disposed around the periphery of the resonance plate 32 and securely attached on the gas inlet plate 31.

Please refer to FIGS. 3A, 3B and 4A, again. The piezoelectric actuator 33 is attached to the resonance plate 32 and is corresponding in position to the resonance plate 32. The piezoelectric actuator 33 includes a suspension plate 33*a*, an outer frame 33*b*, at least one bracket 33*c*, a piezoelectric element 33*d*, at least one clearance 33*e* and a bulge 33E The suspension plate 33*a* is square-shaped because the square suspension plate 33*a* is more power-saving than the circular suspension plate. Generally, the consumed power of the capacitive load operated under the resonance frequency would induce as the resonance frequency raised. Since the resonance frequency of the square suspension plate 33*a* is obviously lower than that of the circular square suspension plate, the consumed power of the square suspension plate 33*a* would be lesser. Therefore, the square suspension plate 33*a* utilized in the present disclosure has the advantage of power-saving. In this embodiment, the outer frame 33*b* is disposed around the periphery of the suspension plate 33*a*, and at least one bracket 33*c* is connected between the suspension plate 33*a* and the outer frame 33*b* for elastically supporting the suspension plate 33*a*. The piezoelectric element 33*d* has a side, and the length of the side of the piezoelectric element 33*d* is less than or equal to that of the suspension plate 33*a*. The piezoelectric element 33*d* is attached to a surface of the suspension plate 33*a*. When a voltage is applied to the piezoelectric element 33*d*, the suspension plate 33*a* is driven to undergo the bending vibration. The at least one clearance 33*e* is formed between the suspension plate 33*a*, the outer frame 33*b* and the at least one bracket 33*c* for allowing the gas to flow through. The bulge 33*f* is formed on a surface of the suspension plate 33*a* opposite to the surface of the suspension plate 33*a* attached to the piezoelectric element 33*d*. In this embodiment, the bulge 33*f* is formed by an etching process on the suspension plate 33*a*. Accordingly, the bulge 33*f* of the suspension plate 33*a* is integrally formed and protrudes from the surface opposite to the one that the piezoelectric element 33*d* is attached thereon, and formed a convex structure.

Please refer to FIGS. 3A, 3B and 4A. In this embodiment, the gas inlet plate 31, the resonance plate 32, the piezoelectric actuator 33, the first insulation plate 34, the conducting plate 35 and the second insulation plate 36 are stacked and assembled sequentially. A chamber space 37 is formed between the suspension plate 33*a* and the resonance plate 32, and the chamber space 37 is formed by filling a gap between the resonance plate 32 and the outer frame 33*b* of the piezoelectric actuator 33 with a material, such as a conductive adhesive, but not limited thereto. Therefore, a specific depth between the resonance plate 32 and the suspension plate 33*a* is maintained and formed as the chamber space 37, so as to guide the gas to pass rapidly. In addition, since the resonance plate 32 and the suspension plate 33*a* are maintained at a suitable distance, the contact interference therebetween can be reduced, thereby largely reducing the noise. In other embodiments, the thickness of the conductive adhesive filled into the gap between the resonance plate 32 and the outer frame 33*b* of the piezoelectric actuator 33 can be reduced by increasing the height of the outer frame 33*b* of the piezoelectric actuator 33. Therefore, the entire assembling structure of gas pump 3 would not be indirectly influenced by the hot-pressing temperature and the cooling temperature, and avoiding the actual distance between the suspension plate 33*a* and the resonance plate 32 of the chamber space 37 being affected by the thermal expansion and contraction of the filling material of the conductive adhesive, but is not limited thereto. In addition, since the transportation effect of the gas pump 3 is affected by the chamber space 37, it is very important to maintain a constant chamber space 37, so as to provide a stable transportation efficiency of the gas pump 3.

Figure 4B:
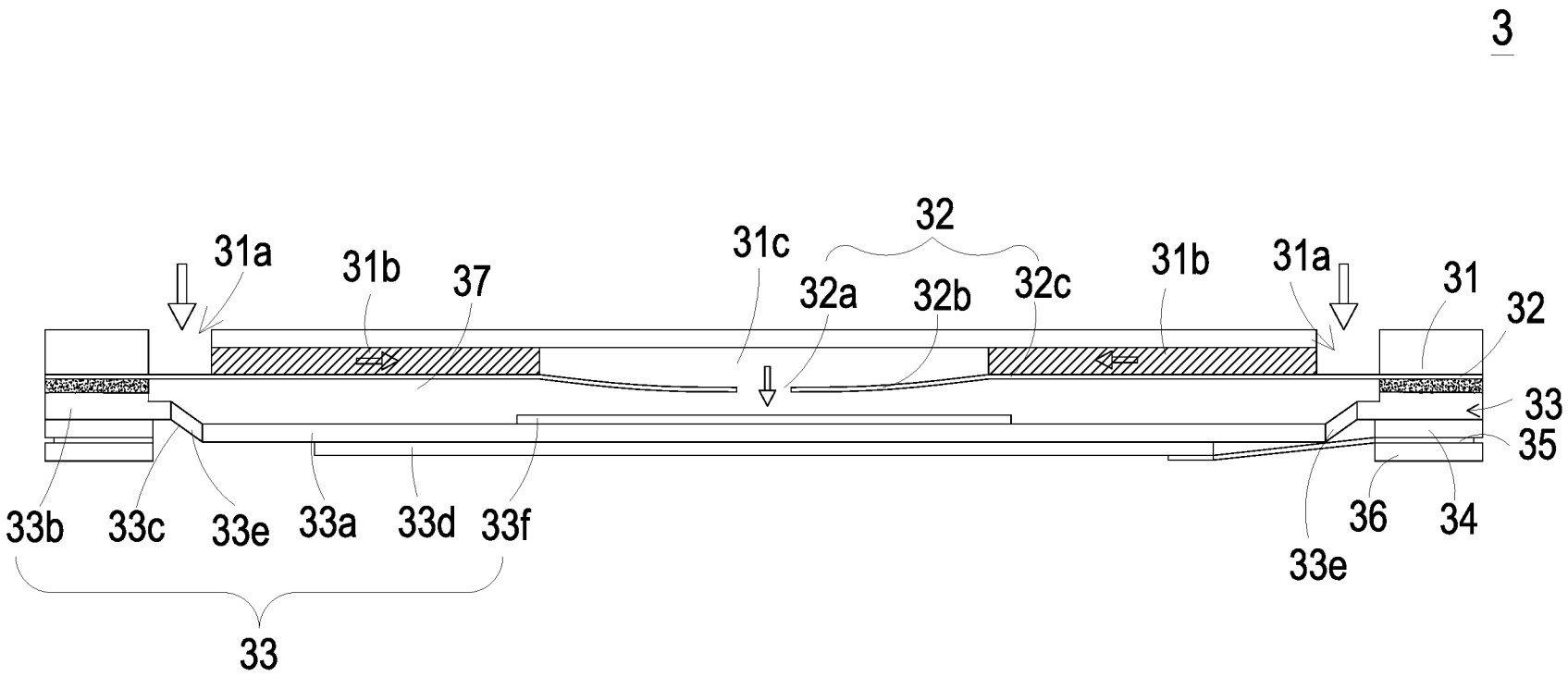
FIGS. 4B to 4D are schematic views illustrating the operation steps of the gas pump of the present disclosure.
Figure 4C:
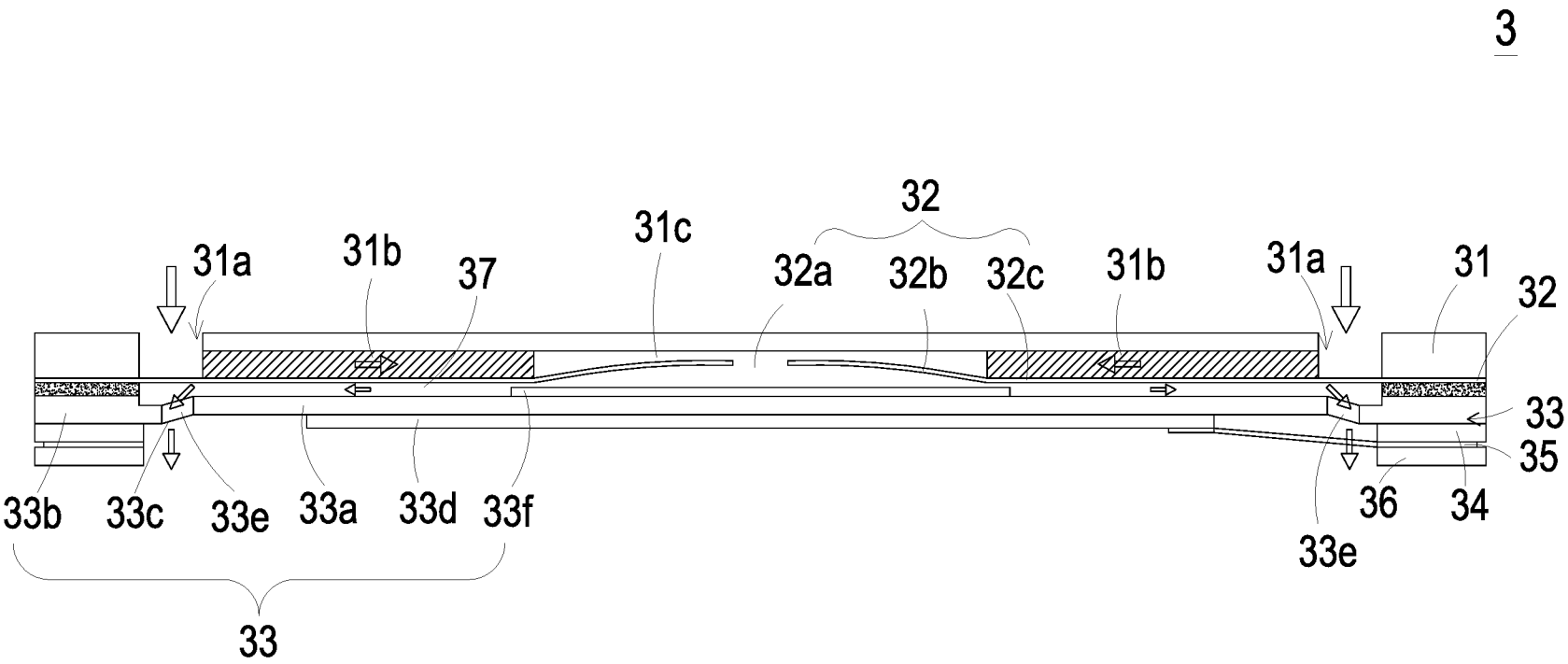
Figure 4D:
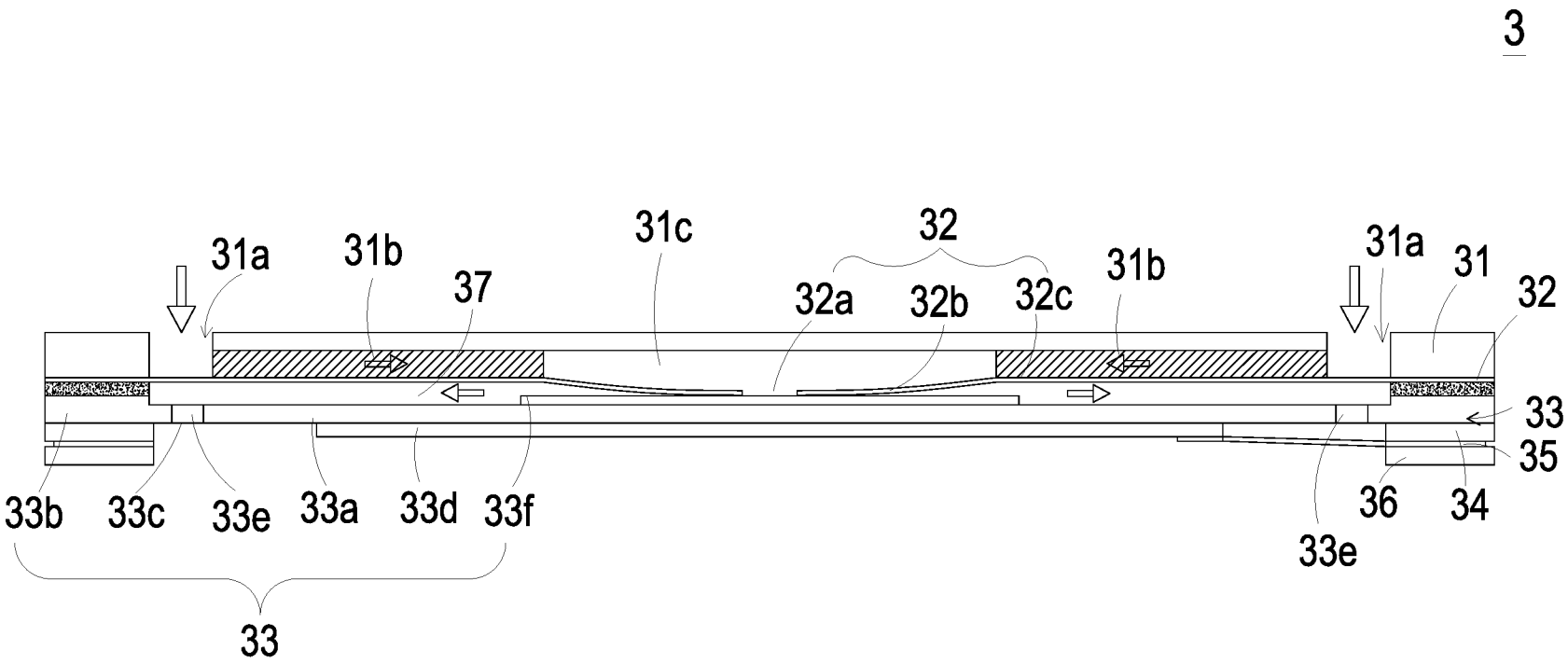

In order to understand the actuation steps of the gas pump 3, please refer to FIGS. 4B to 4D. Referring to FIG. 4B first, when the piezoelectric element 33*d* of the piezoelectric actuator 33 is deformed in response to an applied voltage, the suspension plate 33*a* is driven to displace in the direction away from the resonance plate 32. In that, the volume of the chamber space 37 is increased, a negative pressure is generated in the chamber space 37, and the gas in the convergence chamber 31*c* is introduced into the chamber space 37. At the same time, the resonance plate 32 is displaced synchronously under the influence resonance effect, and thereby, the volume of the convergence chamber 31*c* is increased. Furthermore, a negative pressure state is generated in the convergence chamber 31*c* since the gas in the convergence chamber 31*c* is introduced into the chamber space 37, and the gas is inhaled into the convergence chamber 31*c* through the gas inlet apertures 31*a* and the convergence channels 31*b*. Then, as shown in FIG. 4C, the piezoelectric element 33*d* drives the suspension plate 33*a* to displace upwardly toward the resonance plate 32 to compress the chamber space 37. Similarly, the resonance plate 32 is actuated and displaced upwardly away from the suspension plate 33*a* under the resonance effect of the suspension plate 33*a*, and compress the gas in the chamber space 37. Thus, the gas in the chamber space 37 is further transmitted downwardly to pass through the clearances 33*e* and achieves the effect of gas transportation. Finally, as shown in FIG. 4D, when the suspension plate 33*a* resiliently moves back to an initial state, the resonance plate 32 displaces downwardly toward the suspension plate 33*a* due to its inertia momentum, and pushes the gas in the chamber space 37 toward the clearances 33*e*. Meanwhile, the volume of the convergence chamber 31*c* is increased. Thus, the gas outside is continuously inhaled and passed through the gas inlet apertures 31*a* and the convergence channels 31*b*, and converged into the convergence chamber 31*c*. By repeating the actuation steps illustrated in FIGS. 4B to 4D continuously, the gas pump 3 can continuously transport the gas at high speed. The gas enters the gas inlet apertures 31*a*, flows through a flow path formed by the gas inlet plate 31 and the resonance plate 32 and result in a pressure gradient, and then transported through the clearances 33*e*, so as to achieve the operation of gas transportation of the gas pump 3.

Figure 5A:
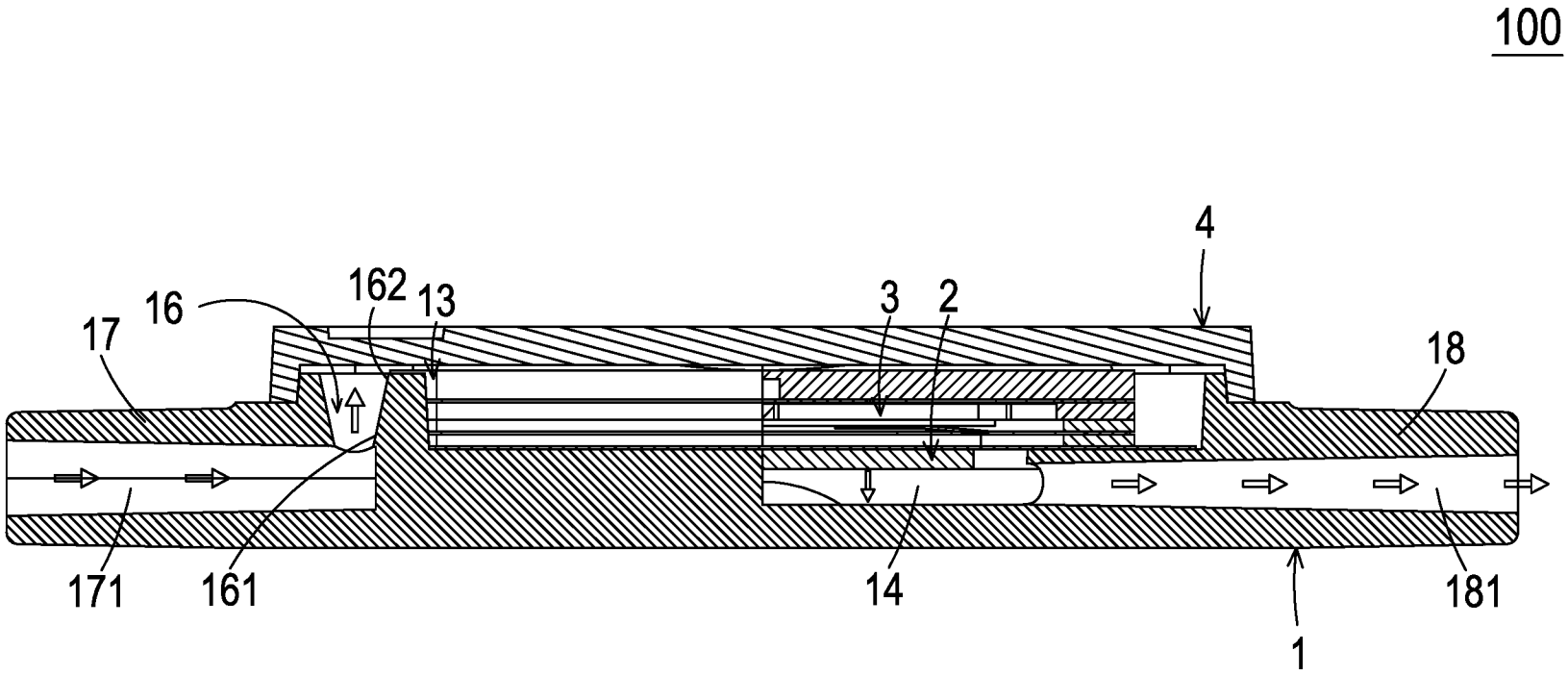
FIG. 5A is a cross-sectional view illustrating the thin gas transportation device of the present disclosure taken along the line A-A of FIG. 2D.

FIG. 5A is a cross-sectional view illustrating the thin gas transportation device of the present disclosure taken along the line A-A of FIG. 2D. As shown in the FIGS. 5A and 5B, when the gas pump 3 is enabled, the gas between the gas inlet plate 31 and the top cover 4 is inhaled into the inlet aperture 31*a* and transported downwardly. Meanwhile, when the gas inside the accommodation slot 13 flows in the gas pump 3, the space inside the accommodation slot 13 turns into a negative pressure status, and the gas outside the thin gas transportation device 100 enters the thin gas transportation device 100 through the inlet passage 171 of the inlet pipe 17 and is introduced into the accommodation slot 13 through the vent hole 16.

Figure 5B:
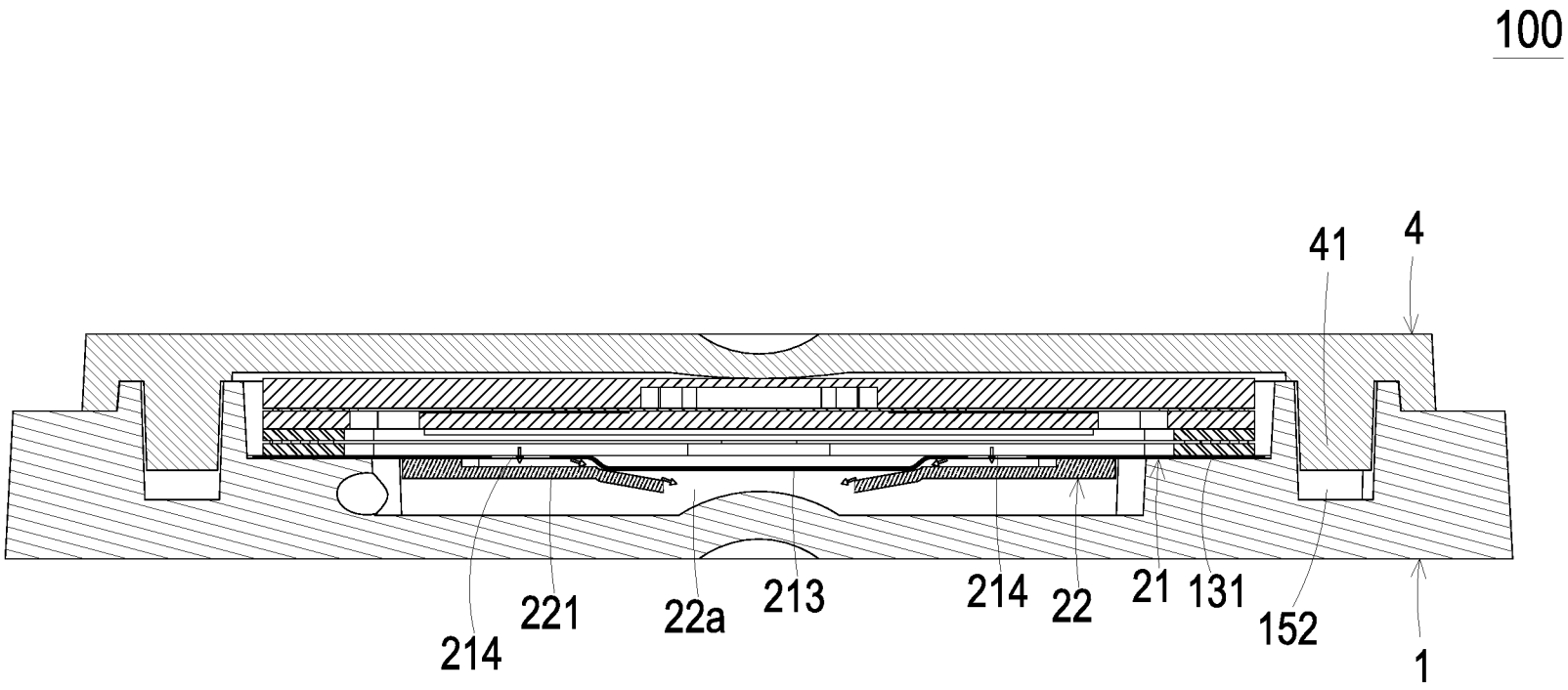
FIG. 5B is a cross-sectional view illustrating the thin gas transportation device of the present disclosure taken along the line B-B of FIG. 2D.

Please refer to FIG. 5B. FIG. 5B is a cross-sectional view illustrating the thin gas transportation device of the present disclosure taken along the line B-B of FIG. 2D. When the gas flows downwardly to the check valve 2, it is then transported to the valve plate 22 through the plurality of perforations 214 of the barrier plate 21. As the gas contacts the valve plate 22 and pushes the valve part 221, the valve hole 22*a* and the valve part 221 surrounding the valve hole 22*a* are separated from the protruding part 213 of the barrier plate 21. Consequently, the valve hole 22*a* is opened and allows the gas to flow into the outlet slot 14 through the valve hole 22*a* and then be discharged through the outlet passage 181 (as shown in FIG. 5A).

Figure 5C:
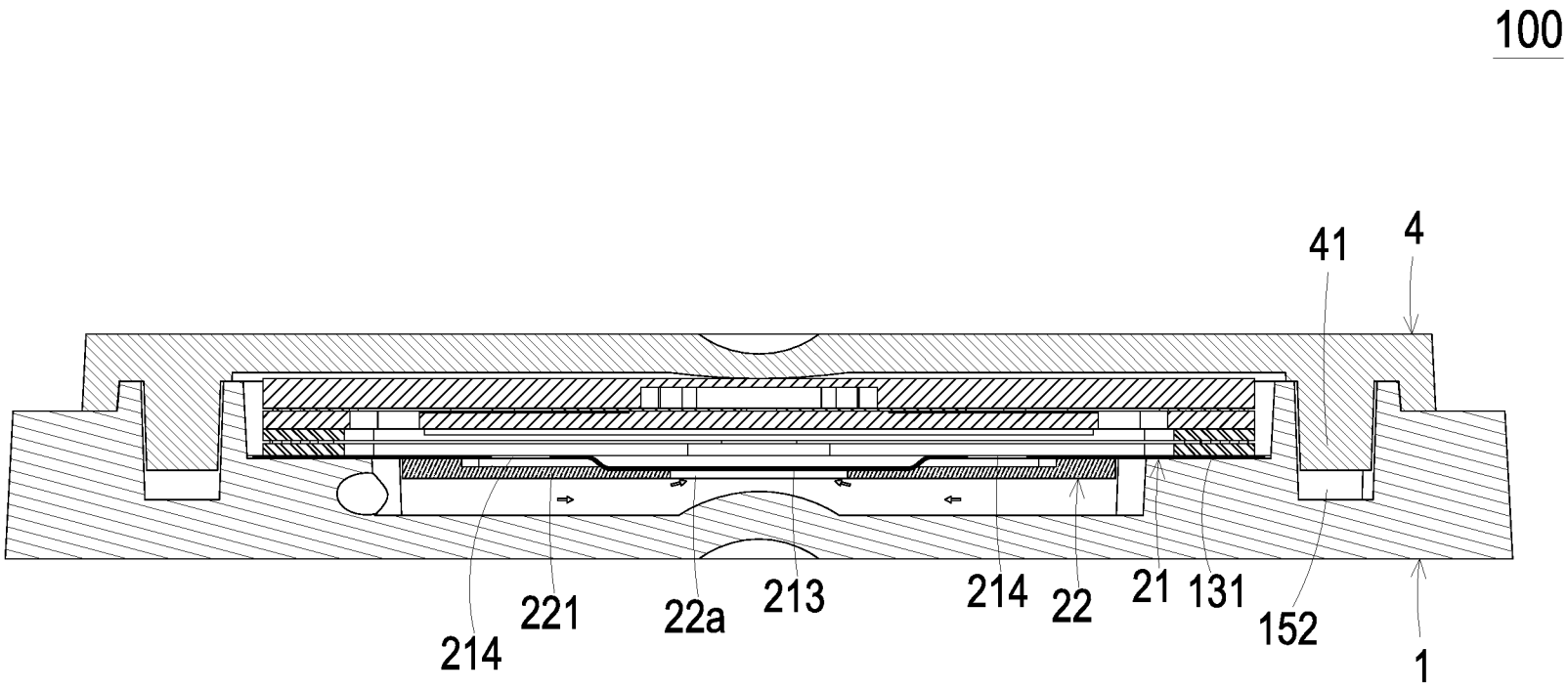
FIG. 5C is a schematic view illustrating the way of preventing the backflow for the thin gas transportation device of the present disclosure.

FIG. 5C is a schematic view illustrating the way of preventing the backflow for the present disclosure. As shown in the FIG. 5C, as the gas pump 3 is disabled, the inner pressure of the space inside the outlet slot 14 is greater than that of the accommodation slot 13. As a result, the gas backflows instantly and pushes the valve part 221 of the valve plate 22 to return to the original position where the protruding part 213 abuts against the valve part 221, and the valve hole 22*a* is closed accordingly. The gas can't pass through the valve hole 22*a* and flow back to the gas pump 3 since the valve hole 22*a* is sealed by the protruding part 213, thereby achieve the effect of preventing backflow.

Please refer to FIGS. 2B and 2C, the positioning part 15 of the shell 1 includes a plurality of fixing structures 151. In this embodiment, the shell 1 and the accommodation slot 13 are both in square shape. The positioning part 15 is matched with the accommodation slot 13 and therefore is square shape, but is not limited thereto. The positioning part 15 includes a plurality of fixing structures 151 and a plurality of positioning holes 152. In this embodiment, the number of the plurality of fixing structures 151 is four, and the fixing structures 151 are respectively arranged on the four corners of the positioning part 15 at intervals. The number of the positioning holes 152 is three, and the positioning holes 152 are respectively disposed on different fixing structures 151. The fixing structure 151 near the inlet pipe 17 is utilized for disposing the vent hole 16 to allow the gas being introduced into the accommodation slot 13 though a short path, and therefore the fixing structure 151 near the inlet pipe 17 does not have the positioning hole 152. Besides, the top cover 4 includes a plurality of tenons 41. The tenons 41 are corresponding to the positioning holes 152, and therefore the number of the tenons 41 is three. The top cover 4 is securely disposed on the positioning part 15 and covers the accommodation slot 13 by inserting the tenons 41 into the positioning holes 152. Both of the numbers of the tenons 41 and the positioning holes 152 are three, so that the tenons 41 and the positioning holes 152 not only can be used for fixing the top cover 4, but also can precisely position the top cover 4, so as to avoid the wrong positioning of the covering process.

The barrier plate 21 of the check valve 2 includes a plurality of positioning notches 215. The plurality of positioning notches 215 are matched with the plurality of fixing structures 151, for example, if the positioning notch 215 is an arc notch, the fixing structure 151 is an arc column. Consequently, when the check valve 2 is disposed within the accommodation slot 13, it can be positioned fast and precisely by aligning the plurality of positioning notches 215 with the plurality of fixing structures 151.

In summary, the present disclosure provides a thin gas transportation device with a gas pump to be disposed on a check valve. When the gas pump is enabled, the gas can be output constantly. When the gas pump is disabled, the check valve can rapidly seal the valve hole to prevent the backflow effectively. In addition, the check valve of the present invention is easy to be manufactured and has high yield rate. The check valve of the present invention solves the problem of hard to maintain quality due to the size of the thin gas transportation device being too-small and the tolerance in massive manufacture.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A thin gas transportation device comprising:

a shell comprising:

a shell surface;

an accommodation slot recessed from the shell surface and comprising an accommodation bottom surface;

an outlet slot recessed from the accommodation bottom surface;

a positioning part protruded from the shell surface and surrounding the accommodation slot;

a vent hole located on the positioning part and comprising an inlet end and a vent end, wherein the vent end is in fluid communication with the accommodation slot, and the vent hole is tapered from the vent end to the inlet end;

an inlet pipe disposed on the shell and comprising an inlet passage, wherein the inlet passage is in fluid communication with the inlet end of the vent hole; and an outlet pipe disposed on the shell and comprising an outlet passage, wherein the outlet passage is in fluid communication with the outlet slot;

a check valve disposed within the accommodation slot and comprising:

a barrier plate disposed on the accommodation bottom surface and covering the outlet slot, wherein the barrier plate comprises:

a first surface;

a second surface opposed to the first surface;

a protruding part protruding from the second surface and located at the outlet slot; and a plurality of perforations surrounding the protruding part;

a valve plate disposed on the second surface and comprising:

a valve part comprising a valve hole, wherein the valve hole is vertically corresponding to the protruding part; and a fixing portion located at the valve part, wherein the valve plate is coupled to the second surface through the fixing portion, and the protruding part abuts against the valve part and seals the valve hole;

a gas pump disposed on the first surface; and a top cover fixed on the positioning part and covers the accommodation slot.

2. The thin gas transportation device according to claim 1, wherein protruding part of the check valve is cylindrical, and a diameter of the protruding part is greater than a diameter of the valve hole of the valve plate.

3. The thin gas transportation device according to claim 2, wherein a thickness of the protruding part of the check valve is greater than a thickness of the fixing portion of the valve plate.

4. The thin gas transportation device according to claim 3, wherein the thickness of the fixing portion is 0.14 mm, and the thickness of the protruding part is 0.2 mm.

5. The thin gas transportation device according to claim 3, wherein the fixing portion is made of a pliable material, and the thickness of the valve part is 0.2 mm.

6. The thin gas transportation device according to claim 5, wherein the fixing portion of the valve plate is an adhesive layer, and the adhesive layer is disposed on a periphery of the valve plate to fix the valve plate on the barrier plate.

7. The thin gas transportation device according to claim 5, wherein the pliable material is silicone, rubber or polyimide thin film.

8. The thin gas transportation device according to claim 3, wherein the barrier plate of the check valve is made of a metal material, and the metal material is copper, aluminum or stainless steel.

9. The thin gas transportation device according to claim 8, wherein a thickness of the barrier plate is 0.05 mm.

10. The thin gas transportation device according to claim 2, wherein the diameter of the valve hole is 3 mm.

11. The thin gas transportation device according to claim 10, wherein the diameter of the protruding part is in a range between 4 mm and 5 mm.

12. The thin gas transportation device according to claim 1, wherein a diameter of each of the plurality of perforations is 1 mm.

13. The thin gas transportation device according to claim 1, wherein the positioning part comprises a plurality of fixing structures arranged at intervals.

14. The thin gas transportation device according to claim 13, wherein positioning part comprises a plurality of positioning holes, and the plurality of positioning holes are respectively disposed on the plurality of fixing structures, wherein the top cover comprises a plurality of tenons, and the plurality of tenons are correspondingly penetrated through and disposed in the plurality of positioning holes.

15. The thin gas transportation device according to claim 13, wherein the vent hole is disposed within one of the plurality of fixing structures.

16. The thin gas transportation device according to claim 13, wherein the barrier plate of the check valve comprises a plurality of positioning notches, and the plurality of positioning notches and the plurality of fixing structures are matched with each other.

17. The thin gas transportation device according to claim 16, wherein the plurality of positioning notches are in arc shapes.

18. The thin gas transportation device according to claim 1, wherein the gas pump comprises:

an gas inlet plate having at least one inlet aperture, at least one convergence channel and a convergence chamber, wherein the at least one inlet aperture is configured to inhale gas, the at least one inlet aperture correspondingly penetrates through the gas inlet plate into the at least one convergence channel, and the at least one convergence channel is converged into the convergence chamber, so that the gas inhaled through the at least one inlet aperture is converged into the convergence chamber;

a resonance plate disposed on the gas inlet plate and having a central aperture, a movable part and a fixed part, wherein the central aperture is disposed at a center of the resonance plate and is corresponding to the convergence chamber of the gas inlet plate, the movable part surrounds the central aperture and is corresponding to the convergence chamber, and the fixed part surrounds the movable part and is securely attached on the gas inlet plate; and a piezoelectric actuator correspondingly disposed on the resonance plate;

wherein a chamber space is formed between the resonance plate and the piezoelectric actuator, so that when the piezoelectric actuator is driven, the gas introduced from the at least one inlet aperture of the gas inlet plate is converged to the convergence chamber through the at least one convergence channel, and flows through the central aperture of the resonance plate so as to generate a resonance effect with the movable part of the resonance plate and the piezoelectric actuator to transport the gas.

19. The thin gas transportation device according to claim 18, wherein the piezoelectric actuator comprises:

a suspension plate in square-shape permitted to undergo a bending vibration;

an outer frame surrounding the suspension plate;

at least one bracket connected between the suspension plate and the outer frame to provide an elastic support for the suspension plate; and a piezoelectric element having a side, wherein a length of the side of the piezoelectric element is less than or equal to that of the suspension plate, and the piezoelectric element is attached on a surface of the suspension plate, wherein when a voltage is applied to the piezoelectric element, the suspension plate is driven to undergo the bending vibration.

20. The thin gas transportation device according to claim 19, wherein the gas pump comprises a first insulation plate, a conducting plate and a second insulation plate, wherein the gas inlet plate, the resonance plate, the piezoelectric actuator, the first insulation plate, the conducting plate and the second insulation plate are stacked and assembled sequentially.

* * * * *